US010494901B2

(12) United States Patent
Zhang et al.

(10) Patent No.: US 10,494,901 B2
(45) Date of Patent: Dec. 3, 2019

(54) BALL-DROPPING SLIDING SLEEVE WITH A REMOVABLE BALL SEAT

(71) Applicant: CNPC Xibu Drilling Engineering Company Limited, Urumqi (CN)

(72) Inventors: Shengpeng Zhang, Urumqi (CN); Xiaojun Li, Urumqi (CN); Fei Gao, Urumqi (CN); Feiyue Wang, Urumqi (CN); Xin Zhang, Urumqi (CN); Fuqiang Li, Urumqi (CN)

(73) Assignee: CNPC Xibu Drilling Engineering Company Limited, Urumqi (CN)

( * ) Notice: Subject to any disclaimer, the term of this patent is extended or adjusted under 35 U.S.C. 154(b) by 115 days.

(21) Appl. No.: 15/727,652

(22) Filed: Oct. 9, 2017

(65) Prior Publication Data

US 2018/0051538 A1 Feb. 22, 2018

Related U.S. Application Data

(63) Continuation of application No. PCT/CN2016/077368, filed on Mar. 25, 2016.

(30) Foreign Application Priority Data

Apr. 9, 2015 (CN) ..... 2015 1 0165335

(51) Int. Cl.
*E21B 34/00* (2006.01)
*E21B 34/14* (2006.01)

(52) U.S. Cl.
CPC ..... *E21B 34/14* (2013.01); *E21B 2034/007* (2013.01)

(58) Field of Classification Search
CPC combination set(s) only.
See application file for complete search history.

(56) References Cited

U.S. PATENT DOCUMENTS 3,799,268 A 3/1974 Cochran
4,640,351 A 2/1987 Clifton et al.
(Continued)

FOREIGN PATENT DOCUMENTS

CN 202338321 U 7/2012
CN 103015952 A 4/2013
(Continued)

OTHER PUBLICATIONS

International Search Report for co-pending International Application No. PCT/CN2016/077368 dated Jun. 30, 2016 with English translation.

(Continued)

*Primary Examiner* — David J Bagnell
*Assistant Examiner* — Ronald R Runyan
(74) *Attorney, Agent, or Firm* — Renner, Otto, Boisselle & Sklar, LLP

(57) ABSTRACT

A ball-dropping sliding sleeve with a removable ball seat, comprising an outer barrel (1), an inner sliding sleeve (6) and a removable ball seat assembly; an inner ring downward facing shoulder (2) is disposed at an upper end of the outer barrel (1), a lower joint (3) is fixedly mounted in a lower end of the outer barrel (1), a sliding groove (4) is formed in the outer barrel (1) between the downward facing shoulder (2) and the lower joint (3), and at least one fracturing lateral hole (5) is distributed on a circumference of the outer barrel (1) at an upper side of the sliding groove (4). The structure of the present invention is reasonable and compact, and its usage is convenient. Through the coiled tubing, a connecting sleeve (10), a ball seat sleeve (7) and a ball seat (15) which are located inside the inner sliding sleeve (6) can be lifted up and taken out, which widens the inner channel of the sliding sleeve, eliminates the restriction of the inner diameter of the ball seat (15), and facilitates the post-processing of the (Continued)

complex situations; the pressure relieving channel formed by the pressure relieving holes in the ball seat (15) and the ball seat circular groove (17) can relieve the pressure and facilitating the lifting.

18 Claims, 6 Drawing Sheets

(56) References Cited

U.S. PATENT DOCUMENTS

| | | | | |
|---|---|---|---|---|
| 5,810,084 | A * | 9/1998 | Echols | E21B 17/06 166/242.7 |
| 2010/0200220 | A1 | 8/2010 | Beall et al. | |
| 2011/0259595 | A1 | 10/2011 | Nguy et al. | |
| 2014/0352970 | A1* | 12/2014 | Kristoffer | E21B 43/12 166/318 |

FOREIGN PATENT DOCUMENTS

| | | | |
|---|---|---|---|
| CN | 103089227 | A | 5/2013 |
| CN | 202946131 | A | 5/2013 |
| CN | 103321608 | A | 9/2013 |
| CN | 103590800 | A | 2/2014 |
| CN | 103821488 | A | 5/2014 |
| CN | 203603869 | U | 5/2014 |
| CN | 203742576 | U | 7/2014 |
| CN | 104405300 | A | 3/2015 |
| CN | 104790909 | A | 7/2015 |
| CN | 204571931 | U | 8/2015 |
| KZ | 694 | U | 8/2011 |
| RU | 2527043 | C2 | 8/2014 |

OTHER PUBLICATIONS

Written Opinion of the International Searching Authority for co-pending International Application No. PCT/CN2016/077368 dated Jun. 30, 2016.

First Office Action and Search Report dated Nov. 14, 2016 for corresponding Chinese Patent Application No. 201510165335.3, along with English translation downloaded from EPO.

Second Office Action dated Jul. 10, 2017 for corresponding Chinese Patent Application No. 201510165335.3, along with English translation downloaded from EPO.

First Office Action for corresponding Kazakhstan Patent Application No. 2017/1014.1 dated Feb. 22, 2019 and its English translation.

GOST 19257-73. Holes for threading metric thread. Diameters. Interstate standard. Jun. 12, 1973. p. 1.

* cited by examiner

BALL-DROPPING SLIDING SLEEVE WITH A REMOVABLE BALL SEAT

CROSS-REFERENCE TO RELATED APPLICATIONS

This application is a continuation of International Application No. PCT/CN2016/077368, filed on Mar. 25, 2016, which claims priority to Chinese Patent Application No. 201510165335.3, filed on Apr. 9, 2015, both of which are hereby incorporated by reference in their entireties.

TECHNICAL FIELD

The present invention relates to the technical field of fracturing sliding sleeves, and particularly, to a ball-dropping sliding sleeve with a removable ball seat.

BACKGROUND

The fracturing well completion is one very common technical means in the well completion operation. When the fracturing well completion is carried out, a fracturing sliding sleeve is usually used, and the ball-dropping pressure-out mode is adopted to open the fracturing channel connecting the inner and outer ring spaces. Most of the existing fracturing sliding sleeves are irremovable and restricted by their internal ball seats, and it is difficult to deal with complex down-hole situations such as down-hole water leakage. Thus the post-processing is troublesome.

SUMMARY

The present invention provides a ball-dropping sliding sleeve with a removable ball seat to overcome the shortages of the prior art, which effectively solves the problem that when a fracturing well completion is carried out with a fracturing sliding sleeve, it is difficult to deal with the complex situations at the late time due to the irremovable fracturing sliding sleeve and the restriction from the internal ball seat.

The technical solution of the present invention is realized through the following measures: a ball-dropping sliding sleeve with a removable ball seat, comprising an outer barrel, an inner sliding sleeve and a removable ball seat assembly; wherein a downward facing shoulder is disposed at an upper end of the outer barrel, a lower joint is fixedly mounted in a lower end of the outer barrel, a sliding groove is formed in the outer barrel between the downward facing shoulder and the lower joint, at least one fracturing lateral hole is distributed on a circumference of the outer barrel at an upper side of the sliding groove, the inner sliding sleeve capable of blocking the at least one fracturing lateral hole is mounted in an upper portion of the sliding groove and fixedly mounted with the outer barrel through a first shear pin; there is a release sliding distance between a lower end of the inner sliding sleeve and the lower joint; and the removable ball seat assembly that can be taken out by being lifted up is mounted in the inner sliding sleeve.

The technical solution of the present invention is further optimized and/or improved as follows:

the removable ball seat assembly comprises a ball seat sleeve, a connecting sleeve, a limiting barrel, a ball seat and a second shear pin; at least two elastic claw pieces radially extensible are fixed on a circumference at an upper end of the ball seat sleeve, an outer suspended clamp table is disposed at an upper end of each of the elastic claw pieces, and an inner clamp groove is disposed at a middle portion of the inner sliding sleeve; the connecting sleeve capable of pressing the elastic claw piece outward is fixedly connected into the ball seat sleeve through the second shear pin, the outer suspended clamp table is clamped in the inner clamp groove, and a lower portion of the ball seat sleeve is sleeved inside the lower joint; a claw piece collecting groove is disposed on an outer ring surface of the connecting sleeve at a lower side of the outer suspended clamp table; an outer ring table is disposed on the connecting sleeve at a lower side of the claw piece collecting groove, a circular groove opening downward is formed between the connecting sleeve at a lower end of the outer ring table and the ball seat sleeve, and an inner limiting clamp table is disposed at a middle portion of the ball seat sleeve and located in an upper side of the circular groove; the limiting barrel is fixed at an outer side of a lower end of the connecting sleeve, and an upper portion of the limiting barrel is located in a lower side of the circular groove; between a lower end of the inner limiting clamp table and an upper end of the limiting barrel, there is a longitudinal movement distance allowing to lift up the connecting sleeve and release the ball seat sleeve; the longitudinal movement distance is larger than a distance from a top of the outer suspended clamp table to a top of the claw piece collecting groove; and the ball seat is fixedly mounted in a lower side of the ball seat sleeve, and a lower end of the limiting barrel is sealed at an outer side of the ball seat.

An externally threaded boss is disposed at a lower end of an outer side of the ball seat, and the ball seat is fixedly thread-mounted in a lower side of the ball seat sleeve through the externally threaded boss; a ball seat circular groove opening upward is formed between the ball seat at an upper end of the externally threaded boss and the ball seat sleeve; a lower side of the limiting barrel is sealing mounted in the ball seat circular groove at the outer side of the ball seat; and a ball seat tapered table wide at top and narrow at bottom is disposed at an upper end of an inner side of the ball seat, and pressure relieving holes capable of communicating the ball seat with the ball seat circular groove are distributed on the circumference of the ball seat at a lower side of the ball seat tapered table.

An anti-return device for preventing the connecting sleeve from going back in an upward movement is mounted between the outer ring table and the ball seat sleeve; the anti-return device comprises an opened anti-return ring; a mounting groove is disposed at a middle portion of an outer ring surface of the outer ring table, the opened anti-return ring is mounted in the mounting groove, an outer ring claw table inclined outward and downward is disposed on an outer ring surface of the opened anti-return ring, ratch grooves inclined inward and upward and capable of being meshed with the outer ring claw table are longitudinally distributed on the inner ring surface of the ball seat sleeve, and an outer end of the outer ring claw table can be clamped in anyone of the ratch grooves; a lower joint is fixedly mounted in the ball seat sleeve at a lower end of the ball seat and has a barrel shape; gaps are distributed on the circumference at a lower portion of the lower joint and separate the lower joint into at least two connecting claw pieces, and inclined outward and upward hook teeth are longitudinally distributed on an outer side of the connecting claw piece at an interval; and hook grooves which can be occluded with hook teeth are longitudinally distributed in an upper side of the connecting sleeve at an interval.

Long grooves are distributed on the circumference at a lower portion of the inner sliding sleeve, and separate the inner sliding sleeve into at least two sleeve reeds with arc-shaped cross-sections; a sleeve blocker is disposed at an outer side of a lower portion of the sleeve reed, an upper portion of the sleeve blocker is inclined to form a lead-in tapered table narrow at top and wide at bottom, and a lower portion of the sleeve blocker is inclined to form a lead-out tapered table wide at top and narrow at bottom; an upper limiting clamp groove for bringing the fracturing lateral hole into a blocked state is disposed on an inner wall of the outer barrel corresponding to the sleeve blocker, and the sleeve blocker is clamped in the upper limiting clamp groove; and a lower limiting clamp groove for bringing the fracturing lateral hole into an opened state is disposed on the outer barrel below the upper limiting clamp groove.

A sealing ring is fixedly mounted between the inner sliding sleeve and the outer barrel above and below the fracturing lateral hole, respectively; at least one sealing ring is longitudinally fixedly mounted between the connecting sleeve above the ball seat sleeve and the inner sliding sleeve; a sealing ring is fixedly mounted between the inner sliding sleeve above the sleeve reed and the outer barrel; a sealing ring is fixedly mounted between the lower joint and the outer barrel; and a sealing ring is fixedly mounted between an outer side of an upper end of the ball seat and an inner side of a lower end of the limiting barrel.

Horizontal threaded holes are disposed on the elastic claw pieces at the outer suspended clamp table, respectively, and a locating tooling hole is disposed on the inner sliding sleeve corresponding to the threaded hole.

The structure of the present invention is reasonable and compact, and its usage is convenient. Through the coiled tubing, the connecting sleeve, the ball seat sleeve and the ball seat which are located inside the inner sliding sleeve can be lifted up and taken out, which widens the inner channel of the sliding sleeve, eliminates the restriction of the inner diameter of the ball seat, and facilitates the post-processing of the complex situations; the pressure relieving channel formed by the pressure relieving holes in the ball seat and the ball seat circular groove can relieve the pressure and facilitating the lifting; and by using the ball seat sleeve and the lower joint with the hook teeth engaged with the hook groove, the removable ball seat assemblies of a plurality of fracturing sliding sleeves can be connected end to end, and taken out of the well together, thus the operation is convenient.

BRIEF DESCRIPTIONS OF THE DRAWINGS

In order to more clearly describe the technical solutions in the embodiments of the present invention, the drawings to be used in the descriptions of the embodiments will be briefly introduced as follows. Obviously, the following drawings just illustrate some embodiments of the present invention, and a person skilled in the art can obtain other drawings based on them without paying any creative effort.

1: outer barrel; 2: downward facing shoulder; 3: lower joint; 4: sliding groove; 5: fracturing lateral hole; 6: inner sliding sleeve; 7: ball seat sleeve; 8: elastic claw piece; 9: outer suspended clamp table; 10: connecting sleeve; 11: claw piece collecting groove; 12: outer ring table; 13: inner limiting clamp table; 14. limiting barrel; 15: ball seat; 16: externally threaded boss; 17: ball seat circular groove; 18: pressure relieving hole; 19: lower joint; 20: connecting claw piece; 21: hook tooth; 22: opened anti-return ring; 23: sleeve reed; 24: sleeve blocker; 25: lower limiting clamp groove; 26: sealing ring; 27: first shear pin; 28: second shear pin; 29: threaded hole; 30: locating tooling hole; 31: upper limiting groove; 61: long groove.

DETAILED DESCRIPTIONS OF THE PREFERRED EMBODIMENTS

Next, the technical solutions in the embodiments of the present invention will be clearly and completely described with reference to the drawings in the embodiments of the present invention. Obviously, those described are just a part rather than all of the embodiments. Based on the embodiments of the present invention, any other embodiment obtained by a person skilled in the art without paying any creative effort shall fall within the protection scope of the present invention.

The present invention is not limited to the following embodiments, and the implementations can be determined based on the technical solutions of the present invention and actual condition.

Figure 1:
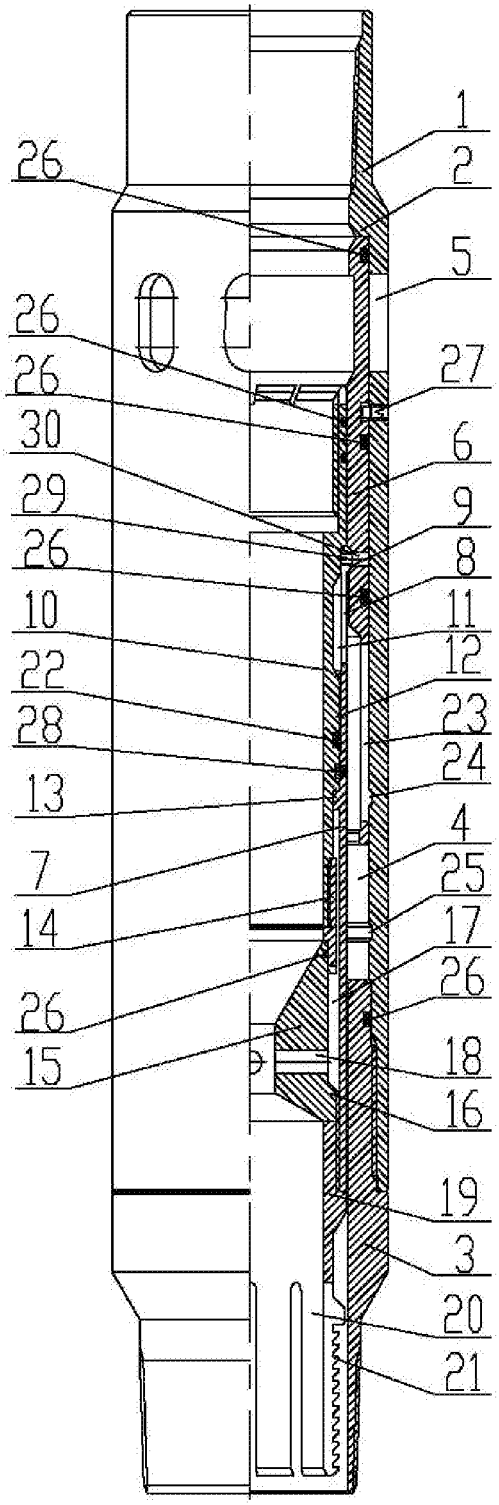
FIG. 1 is a front view of a half-sectional structure of an optimum embodiment of the present invention.

In the present invention, for the convenience of description, the relative positional relations between respective parts are described based on the layout in FIG. 1, e.g., the positional relations such as upper, lower, left and right are described based on the directions in FIG. 1.

Next, the present invention is further described in junction with the embodiments and the drawings.

Figure 2:
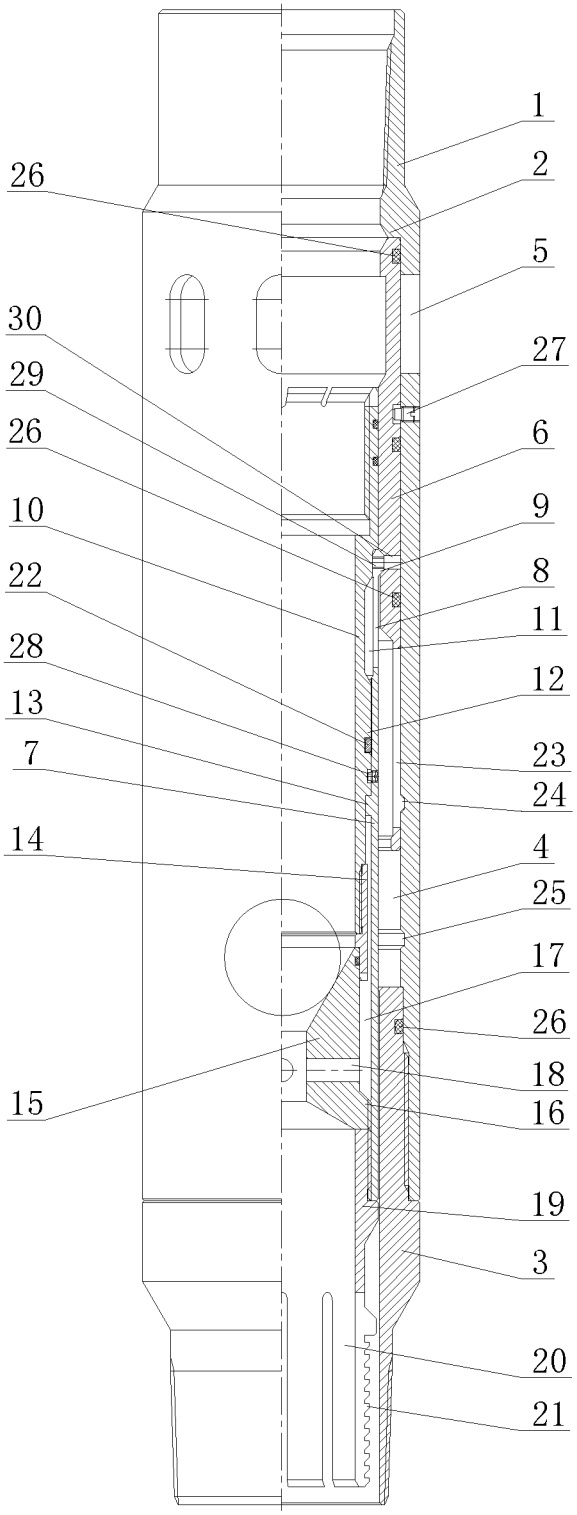
FIG. 2 is a structure view of a ball-dropping sliding sleeve with a removable ball seat of the present invention into which a setting ball is dropped.
Figure 3:
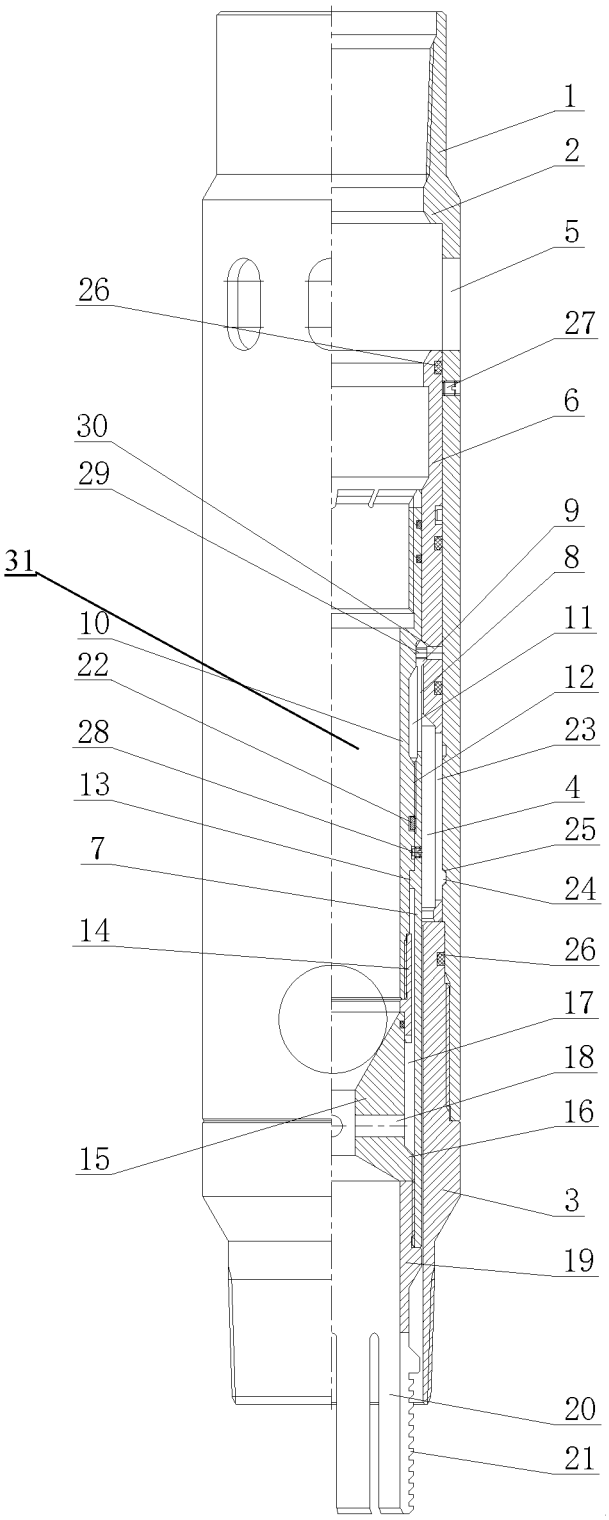
FIG. 3 is a structure view of a ball-dropping sliding sleeve with a removable ball seat of the present invention into which a setting ball is dropped and a fracturing lateral hole is opened.

As illustrated in FIG. 1, the ball-dropping sliding sleeve with a removable ball seat comprises an outer barrel 1, an inner sliding sleeve 6 and a removable ball seat assembly; a downward facing shoulder 2 is disposed at an upper end of the outer barrel 1, a lower joint 3 is fixedly mounted in a lower end of the outer barrel 1, a sliding groove 4 is formed in the outer barrel 1 between the downward facing shoulder 2 and the lower joint 3, at least one fracturing lateral hole 5 is distributed on a circumference of the outer barrel 1 at an upper side of the sliding groove 4, and an inner sliding sleeve 6 capable of blocking the fracturing lateral hole 5 is mounted in an upper portion of the sliding groove 4 and fixedly mounted with the outer barrel 1 through a first shear pin 27; there is a release sliding distance between a lower end of the inner sliding sleeve 6 and the lower joint 3; and a removable ball seat assembly that can be taken out by being lifted up is mounted in the inner sliding sleeve 6. As illustrated in FIGS. 2 and 3, through ball-dropping pressure-out, the first shear pin 27 is cut off, the inner sliding sleeve 6 moves downward, and the fracturing channel is opened by opening the fracturing lateral hole 5; after the fracturing channel is opened, the removable ball seat assembly can be taken out by placing a coiled tubing into the removable ball seat assembly; the inner channel of the taken out sliding sleeve is widened, and is not restricted by the inner diameter of the ball seat, which is convenient for placing some detecting and repairing tools of large diameters underground via the sliding sleeve, for dealing with the complex situations such as down-hole water leakage. The operation is simple and solves the difficulty in fracturing well post-processing, thus ensuring the effective implementation of the down-hole operation.

The ball-dropping sliding sleeve with a removable ball seat may be further optimized and/or improved upon the actual demand.

As illustrated in FIG. 1, the removable ball seat assembly comprises a ball seat sleeve 7, a connecting sleeve 10, a limiting barrel 14, a ball seat 15 and a second shear pin 28; at least two elastic claw pieces 8 radially extensible are fixed on the circumference at an upper end of the ball seat sleeve 7, an outer suspended clamp table 9 is disposed at an upper end of each of the elastic claw pieces 8, and an inner clamp groove is disposed at a middle portion of the inner sliding sleeve 6; the connecting sleeve 10 capable of pressing the elastic claw piece 8 outward is fixedly connected into the ball seat sleeve 7 through the second shear pin 28, the outer suspended clamp table 9 is clamped in the inner clamp groove, and a lower portion of the ball seat sleeve 7 is sleeved inside the lower joint 3; a claw piece collecting groove 11 is disposed on an outer ring surface of the connecting sleeve 10 at a lower side of the outer suspended clamp table 9; an outer ring table 12 is disposed on the connecting sleeve 10 at a lower side of the claw piece collecting groove 11, a circular groove opening downward is formed between the connecting sleeve 10 at a lower end of the outer ring table 12 and the ball seat sleeve 7, and an inner limiting clamp table 13 is disposed at a middle portion of the ball seat sleeve 7, and located in an upper side of the circular groove; a limiting barrel 14 is fixed at an outer side of a lower end of the connecting sleeve 10, and an upper portion of the limiting barrel 14 is located in a lower side of the circular groove; between a lower end of the inner limiting clamp table 13 and an upper end of the limiting barrel 14, there is a longitudinal movement distance allowing to lift up the connecting sleeve 10 and release the ball seat sleeve 7; the longitudinal movement distance is larger than a distance from a top of the outer suspended clamp table 9 to a top of the claw piece collecting groove 11, such that the elastic claw piece 8 can be concealed in the claw piece collecting groove 11; a ball seat 15 is fixedly mounted in a lower side of the ball seat sleeve 7, and a lower end of the limiting barrel 14 is sealed at an outer side of the ball seat 15.

Figure 4:
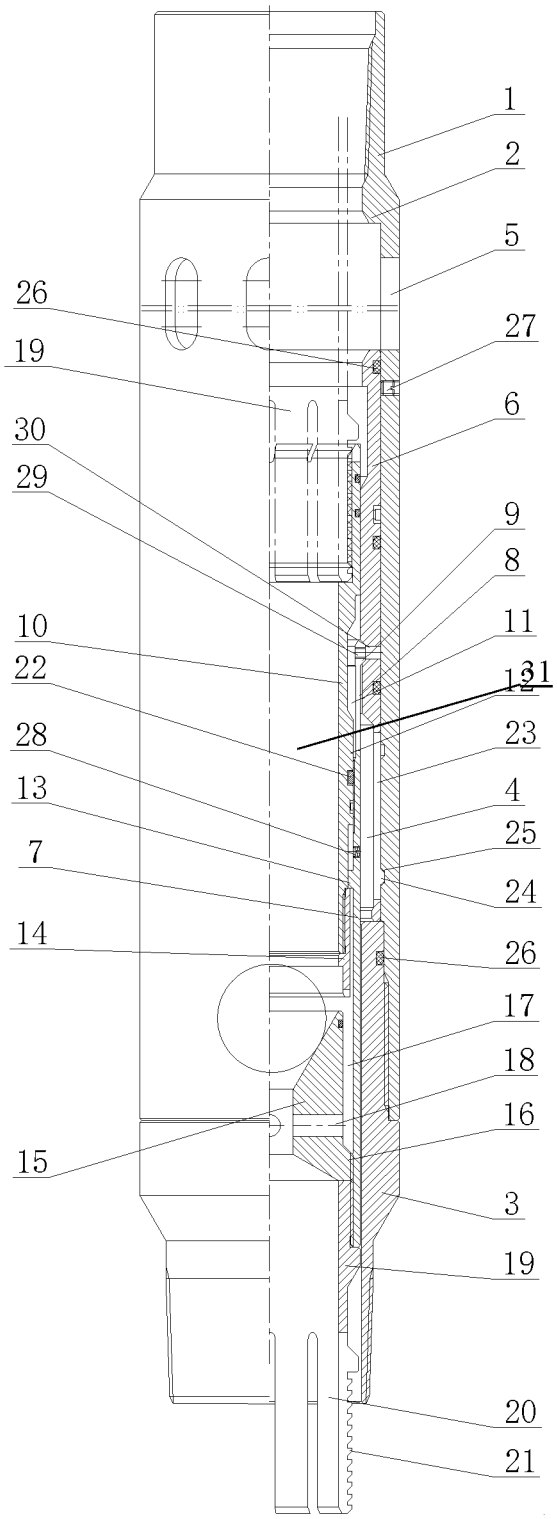
FIG. 4 is a structure view of a ball-dropping sliding sleeve with a removable ball seat of the present invention that is placed into a connection pipe while a removable ball seat assembly is lifted up.

After the fracturing channel is started, as illustrated in FIG. 4, a lower joint, such as a threaded connector, capable of being fixedly connected to the connecting sleeve 10 is placed downward through a coiled tubing, and the coiled tubing is connected to the connecting sleeve 10 using the lower joint; the coiled tubing is lifted up, the second shear pin 28 is cut off, and the connecting sleeve 10 moves upward along with the connecting oil pipe; in this process, when the claw piece collecting groove 11 moves upward to the outer suspended clamp table 9, an upper portion of the elastic claw piece 8 radially retracts into the claw piece collecting groove 11, i.e., the outer suspended clamp table 9 goes away from the inner clamp groove of the inner sliding sleeve 6, then the outer suspended clamp table 9 is released, and the ball seat sleeve 7 goes away from the inner sliding sleeve 6; the lifting is continued, and the limiting barrel 14 at the lower portion of the connecting sleeve 10 abuts against a bottom of the inner limiting clamp table 13, and drives the ball seat sleeve 7 and the ball seat 15 at the bottom to move upward along with the connecting sleeve 10, such that the ball seat 15 is taken out from the well; the operation is simple and convenient, and the connecting sleeve 10, the ball seat sleeve 7 and the ball seat 15 connected in the channel are taken out without influencing the opening of the channel, which widens the inner channel of the sliding sleeve, and it is convenient to place some detecting and repairing tools of large diameters underground via the sliding sleeve.

As illustrated in FIG. 1, an externally threaded boss 16 is disposed at a lower end of an outer side of the ball seat 15, and the ball seat 15 is fixedly thread-mounted in a lower side of the ball seat sleeve 7 through the externally threaded boss 16; a ball seat circular groove 17 opening upward is formed between the ball seat 15 at the upper end of the externally threaded boss 16 and the ball seat sleeve 7; a lower side of the limiting barrel 14 is sealing mounted in the ball seat circular groove 17 at the outer side of the ball seat 15; a ball seat tapered table wide at top and narrow at bottom is disposed at an upper end of an inner side of the ball seat 15, and pressure relieving holes 18 capable of communicating the ball seat 15 with the ball seat circular groove 17 are distributed on the circumference of the ball seat 15 at the lower side of the ball seat tapered table. When the fracturing channel is opened, as illustrated in FIG. 2, a ball is dropped into the well, the setting ball is set at the ball seat tapered table to block the ball seat 15. In that case, when the connecting sleeve 10 is lifted up through the coiled tubing, a low pressure is generated underground and the lifting resistance is increased. In order to solve this problem, pressure relieving holes 18 are added on the ball seat 15 at the lower side of the ball seat tapered table, such that when the connecting sleeve 10 is lifted up through the coiled tubing, the limiting barrel 14 connected at the bottom goes away from the ball seat 15 to cancel the sealing, and inner cavities of the sliding sleeves at the upper and lower sides of the ball seat 15 are communicated with each other through the pressure relieving channel formed by the ball seat circular groove 17 and the pressure relieving holes 18 so as to relieve the pressure and facilitating the lifting operation.

Figure 5:
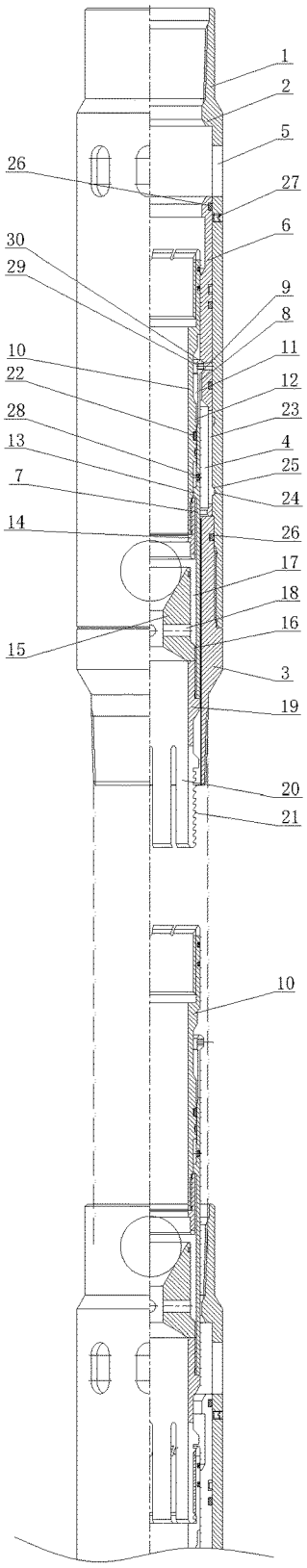
FIG. 5 is a structure view of a ball-dropping sliding sleeve with a removable ball seat of the present invention that presses a connecting sleeve downward.

As illustrated in FIG. 1, an anti-return device for preventing the connecting sleeve 10 from going back in the upward movement is mounted between the outer ring table 12 and the ball seat sleeve 7; the anti-return device comprises an opened anti-return ring 22, a mounting groove is disposed at a middle portion of an outer ring surface of the outer ring table 12, the opened anti-return ring 22 is mounted in the mounting groove, an outer ring claw table inclined outward and downward is disposed on an outer ring surface of the opened anti-return ring 22, ratch grooves inclined inward and upward and capable of being meshed with the outer ring claw table are longitudinally distributed on the inner ring surface of the ball seat sleeve 7, and an outer end of the outer ring claw table can be clamped in anyone of the ratch grooves; a lower joint 19 is fixedly mounted in the ball seat sleeve 7 at a lower end of the ball seat 15 and has a barrel shape; gaps are distributed on the circumference at a lower portion of the lower joint 19 and separate the lower joint 19 into at least two connecting claw pieces 20, and inclined outward and upward hook teeth 21 are longitudinally distributed on an outer side of the connecting claw piece 20 at an interval; hook grooves which can be occluded with hook teeth 21 are longitudinally distributed in an upper side of the connecting sleeve 10 at an interval. The structure composed of the hook teeth 21 on the outer side of the lower joint 19 and the hook grooves in the upper side of the connecting sleeve 10 is usually called as a horse buckle structure. In order to conveniently take out the ball seat 15, the lower joint 19 may be fixed at the lower end of the coiled tubing, and when insertion is directly made into the upper side of the connecting sleeve 10 through the lower joint 19, the hook tooth 21 is occluded in the hook groove, such that the connecting sleeve 10 is connected to the connecting oil pipe, and the operation is convenient; in addition, as to the oil well using a plurality of fracturing sliding sleeves to realize segmented fracturing, the lower joint 19 mounted at the lower end of each of the ball seat sleeves 7 can be used; after the connecting sleeve 10 is lifted up, the connecting sleeve 10 is pressed, as illustrated in FIG. 5, under the effect of the opened anti-return ring 22, the ball seat sleeve 7 and the lower joint 19 move downward along with the connecting sleeve 10, and enter the connecting sleeve 10 of the sliding sleeve at the lower side for being connected with each other; in this way, removable ball seat assemblies of a plurality of fracturing sliding sleeves can be connected end to end underground, and then lifted up and taken out together, which solves the problem of taking out the ball seats 15 of a plurality of fracturing sliding sleeves, and the operation is convenient.

Figure 6:
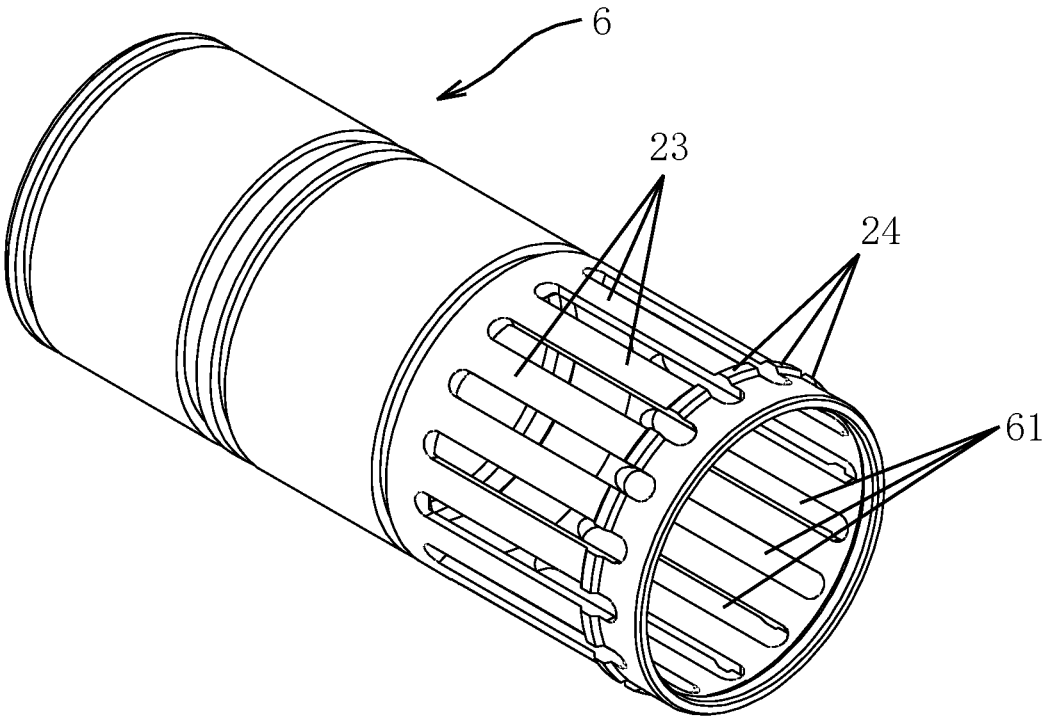
FIG. 6 is a structure view of an inner sliding sleeve.

Referring to FIGS. 1, 3 and 6, long grooves 61 are distributed on the circumference at a lower portion of the inner sliding sleeve 6, and separate the inner sliding sleeve 6 into at least two sleeve reeds 23 with arc-shaped cross-sections; a sleeve blocker 24 is disposed at an outer side of a lower portion of the sleeve reed 23, an upper portion of the sleeve blocker 24 is inclined to form a lead-in tapered table narrow at top and wide at bottom, and a lower portion of the sleeve blocker 24 is inclined to form a lead-out tapered table wide at top and narrow at bottom; an upper limiting clamp groove 31 for bringing the fracturing lateral hole 5 into a blocked state is disposed on an inner wall of the outer barrel 1 corresponding to the sleeve blocker 24, and the sleeve blocker 24 is clamped in the upper limiting clamp groove 31; and a lower limiting clamp groove 25 for bringing the fracturing lateral hole 5 into an opened state is disposed on the outer barrel 1 below the upper limiting clamp groove 31. In the process of opening the fracturing channel, as illustrated in FIG. 3, through ball-dropping pressure-out, the first shear pin 27 is cut off, and the inner sliding sleeve 6 moves downward under a press; at that time, the lead-out tapered table of the sleeve blocker 24 compresses the sleeve reed 23 inward under a reverse thrust from an inclined surface at a lower end of the upper limiting clamp groove 31, such that the sleeve blocker 24 goes away from the upper limiting clamp groove 31 and moves downward along with the inner sliding sleeve 6; when the fracturing lateral hole 5 is opened, the sleeve blocker 24 arrives at and is clamped in the lower limiting clamp groove 25 to limit the inner sliding sleeve 6 under a start state, thereby preventing the inner sliding sleeve 6 from returning.

As illustrated in FIG. 1, a sealing ring 26 is fixedly mounted between the inner sliding sleeve 6 and the outer barrel 1 above and below the fracturing lateral hole 5, respectively; at least one sealing ring 26 is longitudinally fixedly mounted between the connecting sleeve 10 above the ball seat sleeve 7 and the inner sliding sleeve 6; a sealing ring 26 is fixedly mounted between the inner sliding sleeve 6 above the sleeve reed 23 and the outer barrel 1; a sealing ring 26 is fixedly mounted between the lower joint 3 and the outer barrel 1; and a sealing ring 26 is fixedly mounted between an outer side of an upper end of the ball seat 15 and an inner side of a lower end of the limiting barrel 14. The sealing ring 26 functions to improve sealability of the contact surface.

As illustrated in FIG. 1, horizontal threaded holes 29 are disposed on the elastic claw pieces 8 at the outer suspended clamp table 9, respectively, and a locating tooling hole 30 is disposed on the inner sliding sleeve 6 corresponding to the threaded hole 29. When the ball seat sleeve 7 and the connecting sleeve 10 are to be mounted, firstly the elastic claw piece 8 may be fixed on the inner sliding sleeve 6 through a screw, and then the connecting sleeve 10 is mounted in the ball seat sleeve 7, which can prevent an interference between the withdrawn elastic claw piece 8 and the connecting sleeve 10 during tooling, so as to facilitate the assembly. After the assembly, the screw is unscrewed from the locating tooling hole 30.

The above technical features constitute the optimum embodiment of the present invention, which has a strong adaptability and a best implementation effect. Unessential technical features can be added or deleted upon the actual demand to meet the requirements of different conditions.

What is claimed is:

1. A ball-dropping sliding sleeve with a removable ball seat, comprising an outer barrel, an inner sliding sleeve and a removable ball seat assembly, wherein an downward facing shoulder is disposed at an upper end of the outer barrel;

a lower joint is fixedly mounted in a lower end of the outer barrel;

a sliding groove is formed in the outer barrel between the downward facing shoulder and the lower joint;

at least one fracturing lateral hole is located at an upper end of the outer barrel, and distributed on a circumference of the outer barrel;

the inner sliding sleeve capable of blocking the at least one fracturing lateral hole is mounted in an upper portion of the sliding groove and fixedly mounted with the outer barrel through a first shear pin;

there is a release sliding distance between a lower end of the inner sliding sleeve and the lower joint; and the removable ball seat assembly is mounted in the inner sliding sleeve, and can be taken out by being lifted up; wherein the removable ball seat assembly comprises a ball seat sleeve, a connecting sleeve, a limiting barrel, a ball seat and a second shear pin;

at least two elastic claw pieces radially extensible are fixed on a circumference at an upper end of the ball seat sleeve, an outer suspended clamp table is disposed at an upper end of each of the elastic claw pieces, and an inner clamp groove is disposed at a middle portion of the inner sliding sleeve;

the connecting sleeve capable of pressing the elastic claw piece outward is fixedly connected into the ball seat sleeve through the second shear pin, the outer suspended clamp table is clamped in the inner clamp groove, and a lower portion of the ball seat sleeve is sleeved inside the lower joint;

a claw piece collecting groove is disposed on an outer ring surface of the connecting sleeve at a lower side of the outer suspended clamp table;

an outer ring table is disposed on the connecting sleeve at a lower side of the claw piece collecting groove, a circular groove opening downward is formed between the connecting sleeve at a lower end of the outer ring table and the ball seat sleeve, and an inner limiting clamp table is disposed at a middle portion of the ball seat sleeve and located in an upper side of the circular groove;

the limiting barrel is fixed at an outer side of a lower end of the connecting sleeve, and an upper portion of the limiting barrel is located in a lower side of the circular groove;

between a lower end of the inner limiting clamp table and an upper end of the limiting barrel, there is a longitudinal movement distance allowing to lift up the connecting sleeve and release the ball seat sleeve;

the longitudinal movement distance is larger than a distance from a top of the outer suspended clamp table to a top of the claw piece collecting groove; and the ball seat is fixedly mounted in a lower side of the ball seat sleeve, and a lower end of the limiting barrel is sealed at an outer side of the ball seat.

2. The ball-dropping sliding sleeve with the removable ball seat according to claim 1, wherein an externally threaded boss is disposed at a lower end of an outer side of the ball seat, and the ball seat is fixedly thread-mounted in a lower side of the ball seat sleeve through the externally threaded boss;

a ball seat circular groove opening upward is formed between the ball seat at an upper end of the externally threaded boss and the ball seat sleeve;

a lower side of the limiting barrel is sealing mounted in the ball seat circular groove at the outer side of the ball seat; and a ball seat tapered table wide at top and narrow at bottom is disposed at an upper end of an inner side of the ball seat, and pressure relieving holes capable of communicating the ball seat with the ball seat circular groove are distributed on the circumference of the ball seat at a lower side of the ball seat tapered table.

3. The ball-dropping sliding sleeve with the removable ball seat according to claim 2, wherein an anti-return device for preventing the connecting sleeve from going back in an upward movement is mounted between the outer ring table and the ball seat sleeve;

the anti-return device comprises an opened anti-return ring;

a mounting groove is disposed at a middle portion of an outer ring surface of the outer ring table, the opened anti-return ring is mounted in the mounting groove, an outer ring claw table inclined outward and downward is disposed on an outer ring surface of the opened anti-return ring, ratch grooves inclined inward and upward and capable of being meshed with the outer ring claw table are longitudinally distributed on the inner ring surface of the ball seat sleeve, and an outer end of the outer ring claw table can be clamped in anyone of the ratch grooves;

a lower joint is fixedly mounted in the ball seat sleeve at a lower end of the ball seat and has a barrel shape;

gaps are distributed on the circumference at a lower portion of the lower joint and separate the lower joint into at least two connecting claw pieces, and inclined outward and upward hook teeth are longitudinally distributed on an outer side of the connecting claw piece at an interval; and hook grooves which can be occluded with hook teeth are longitudinally distributed in an upper side of the connecting sleeve at an interval.

4. The ball-dropping sliding sleeve with the removable ball seat according to claim 3, wherein long grooves are distributed on the circumference at a lower portion of the inner sliding sleeve, and separate the inner sliding sleeve into at least two sleeve reeds with arc-shaped cross-sections;

a sleeve blocker is disposed at an outer side of a lower portion of the sleeve reed, an upper portion of the sleeve blocker is inclined to form a lead-in tapered table narrow at top and wide at bottom, and a lower portion of the sleeve blocker is inclined to form a lead-out tapered table wide at top and narrow at bottom;

an upper limiting clamp groove for bringing the fracturing lateral hole into a blocked state is disposed on an inner wall of the outer barrel corresponding to the sleeve blocker, and the sleeve blocker is clamped in the upper limiting clamp groove; and a lower limiting clamp groove for bringing the fracturing lateral hole into an opened state enable position limiting is disposed on the outer barrel below the upper limiting clamp groove.

5. The ball-dropping sliding sleeve with the removable ball seat according to claim 4, wherein a sealing ring is fixedly mounted between the inner sliding sleeve and the outer barrel above and below the fracturing lateral hole, respectively;

at least one sealing ring is longitudinally fixedly mounted between the connecting sleeve above the ball seat sleeve and the inner sliding sleeve;

a sealing ring is fixedly mounted between the inner sliding sleeve above the sleeve reed and the outer barrel;

a sealing ring is fixedly mounted between the lower joint and the outer barrel; and a sealing ring is fixedly mounted between an outer side of an upper end of the ball seat and an inner side of a lower end of the limiting barrel.

6. The ball-dropping sliding sleeve with the removable ball seat according to claim 5, wherein horizontal threaded holes are disposed on the elastic claw pieces at the outer suspended clamp table, respectively, and a locating tooling hole is disposed on the inner sliding sleeve corresponding to the threaded hole.

7. The ball-dropping sliding sleeve with the removable ball seat according to claim 2, wherein long grooves are distributed on the circumference at a lower portion of the inner sliding sleeve, and separate the inner sliding sleeve into at least two sleeve reeds with arc-shaped cross-sections;

a sleeve blocker is disposed at an outer side of a lower portion of the sleeve reed, an upper portion of the sleeve blocker is inclined to form a lead-in tapered table narrow at top and wide at bottom, and a lower portion of the sleeve blocker is inclined to form a lead-out tapered table wide at top and narrow at bottom;

an upper limiting clamp groove for bringing the fracturing lateral hole into a blocked state is disposed on an inner wall of the outer barrel corresponding to the sleeve blocker, and the sleeve blocker is clamped in the upper limiting clamp groove; and a lower limiting clamp groove for bringing the fracturing lateral hole into an opened state is disposed on the outer barrel below the upper limiting clamp groove.

8. The ball-dropping sliding sleeve with the removable ball seat according to claim 7, wherein a sealing ring is fixedly mounted between the inner sliding sleeve and the outer barrel above and below the fracturing lateral hole, respectively;

at least one sealing ring is longitudinally fixedly mounted between the connecting sleeve above the ball seat sleeve and the inner sliding sleeve;

a sealing ring is fixedly mounted between the inner sliding sleeve above the sleeve reed and the outer barrel; a sealing ring is fixedly mounted between the lower joint and the outer barrel; and a sealing ring is fixedly mounted between an outer side of an upper end of the ball seat and an inner side of a lower end of the limiting barrel.

9. The ball-dropping sliding sleeve with the removable ball seat according to claim 2, wherein horizontal threaded holes are disposed on the elastic claw pieces at the outer suspended clamp table, respectively, and a locating tooling hole is disposed on the inner sliding sleeve corresponding to the threaded hole.

10. The ball-dropping sliding sleeve with the removable ball seat according to claim 1, wherein an anti-return device for preventing the connecting sleeve from going back in an upward movement is mounted between the outer ring table and the ball seat sleeve;

the anti-return device comprises an opened anti-return ring;

a mounting groove is disposed at a middle portion of an outer ring surface of the outer ring table, the opened anti-return ring is mounted in the mounting groove, an outer ring claw table inclined outward and downward is disposed on an outer ring surface of the opened anti-return ring, ratch grooves inclined inward and upward and capable of being meshed with the outer ring claw table are longitudinally distributed on the inner ring surface of the ball seat sleeve, and an outer end of the outer ring claw table can be clamped in anyone of the ratch grooves;

a lower joint is fixedly mounted in the ball seat sleeve at a lower end of the ball seat and has a barrel shape;

gaps are distributed on the circumference at a lower portion of the lower joint and separate the lower joint into at least two connecting claw pieces, and inclined outward and upward hook teeth are longitudinally distributed on an outer side of the connecting claw piece at an interval; and hook grooves which can be occluded with hook teeth are longitudinally distributed in an upper side of the connecting sleeve at an interval.

11. The ball-dropping sliding sleeve with the removable ball seat according to claim 10, wherein long grooves are distributed on the circumference at a lower portion of the inner sliding sleeve, and separate the inner sliding sleeve into at least two sleeve reeds with arc-shaped cross-sections;

a sleeve blocker is disposed at an outer side of a lower portion of the sleeve reed, an upper portion of the sleeve blocker is inclined to form a lead-in tapered table narrow at top and wide at bottom, and a lower portion of the sleeve blocker is inclined to form a lead-out tapered table wide at top and narrow at bottom;

an upper limiting clamp groove for bringing the fracturing lateral hole into a blocked state is disposed on an inner wall of the outer barrel corresponding to the sleeve blocker, and the sleeve blocker is clamped in the upper limiting clamp groove; and a lower limiting clamp groove for bringing the fracturing lateral hole into an opened state enable position limiting is disposed on the outer barrel below the upper limiting clamp groove.

12. The ball-dropping sliding sleeve with the removable ball seat according to claim 11, wherein a sealing ring is fixedly mounted between the inner sliding sleeve and the outer barrel above and below the fracturing lateral hole, respectively;

at least one sealing ring is longitudinally fixedly mounted between the connecting sleeve above the ball seat sleeve and the inner sliding sleeve;

a sealing ring is fixedly mounted between the inner sliding sleeve above the sleeve reed and the outer barrel;

a sealing ring is fixedly mounted between the lower joint and the outer barrel; and a sealing ring is fixedly mounted between an outer side of an upper end of the ball seat and an inner side of a lower end of the limiting barrel.

13. The ball-dropping sliding sleeve with the removable ball seat according to claim 12, wherein horizontal threaded holes are disposed on the elastic claw pieces at the outer suspended clamp table, respectively, and a locating tooling hole is disposed on the inner sliding sleeve corresponding to the threaded hole.

14. The ball-dropping sliding sleeve with the removable ball seat according to claim 1, wherein long grooves are distributed on the circumference at a lower portion of the inner sliding sleeve, and separate the inner sliding sleeve into at least two sleeve reeds with arc-shaped cross-sections;

a sleeve blocker is disposed at an outer side of a lower portion of the sleeve reed, an upper portion of the sleeve blocker is inclined to form a lead-in tapered table narrow at top and wide at bottom, and a lower portion of the sleeve blocker is inclined to form a lead-out tapered table wide at top and narrow at bottom;

an upper limiting clamp groove is disposed on an inner wall of the outer barrel corresponding to the sleeve blocker, and the sleeve blocker is clamped in the upper limiting clamp groove; and a lower limiting clamp groove is disposed on the outer barrel below the upper limiting clamp groove.

15. The ball-dropping sliding sleeve with the removable ball seat according to claim 14, wherein a sealing ring is fixedly mounted between the inner sliding sleeve and the outer barrel above and below the fracturing lateral hole, respectively;

at least one sealing ring is longitudinally fixedly mounted between the connecting sleeve above the ball seat sleeve and the inner sliding sleeve;

a sealing ring is fixedly mounted between the inner sliding sleeve above the sleeve reed and the outer barrel; a sealing ring is fixedly mounted between the lower joint and the outer barrel; and a sealing ring is fixedly mounted between an outer side of an upper end of the ball seat and an inner side of a lower end of the limiting barrel.

16. The ball-dropping sliding sleeve with the removable ball seat according to claim 1, wherein long grooves are distributed on the circumference at a lower portion of the inner sliding sleeve, and separate the inner sliding sleeve into at least two sleeve reeds with arc-shaped cross-sections;

a sleeve blocker is disposed at an outer side of a lower portion of the sleeve reed, an upper portion of the sleeve blocker is inclined to form a lead-in tapered table narrow at top and wide at bottom, and a lower portion of the sleeve blocker is inclined to form a lead-out tapered table wide at top and narrow at bottom;

an upper limiting clamp groove for bringing the fracturing lateral hole into a blocked state is disposed on an inner wall of the outer barrel corresponding to the sleeve blocker, and the sleeve blocker is clamped in the upper limiting clamp groove; and a lower limiting clamp groove for bringing the fracturing lateral hole into an opened state is disposed on the outer barrel below the upper limiting clamp groove.

17. The ball-dropping sliding sleeve with the removable ball seat according to claim 16, wherein a sealing ring is fixedly mounted between the inner sliding sleeve and the outer barrel above and below the fracturing lateral hole, respectively;

at least one sealing ring is longitudinally fixedly mounted between the connecting sleeve above the ball seat sleeve and the inner sliding sleeve;

a sealing ring is fixedly mounted between the inner sliding sleeve above the sleeve reed and the outer barrel; a sealing ring is fixedly mounted between the lower joint and the outer barrel; and a sealing ring is fixedly mounted between an outer side of an upper end of the ball seat and an inner side of a lower end of the limiting barrel.

18. The ball-dropping sliding sleeve with the removable ball seat according to claim 1, wherein horizontal threaded holes are disposed on the elastic claw pieces at the outer suspended clamp table, respectively, and a locating tooling hole is disposed on the inner sliding sleeve corresponding to the threaded hole.

* * * * *